United States Patent [19]

Jödden et al.

[11] Patent Number: 4,517,163

[45] Date of Patent: May 14, 1985

[54] PROCESS FOR MAKING TITANIUM DIOXIDE CONCENTRATES

[75] Inventors: Klaus Jödden; Gero Heymer, both of Erftstadt; Hans-Werner Stephan, Cologne, all of Fed. Rep. of Germany

[73] Assignee: Hoechst Aktiengesellschaft, Frankfurt, Fed. Rep. of Germany

[21] Appl. No.: 469,220

[22] Filed: Feb. 24, 1983

[30] Foreign Application Priority Data

Mar. 24, 1982 [DE] Fed. Rep. of Germany ..... 3210729

[51] Int. Cl.[3] ..... C01G 23/07; C01G 23/08

[52] U.S. Cl. ..... 423/75; 423/76; 423/79; 75/1 T

[58] Field of Search ..... 423/74, 75, 76, 79; 75/1 T

[56] References Cited

U.S. PATENT DOCUMENTS

| | | | |
|---|---|---|---|
| 1,845,342 | 2/1932 | Saklatwalla | 423/75 |
| 2,184,884 | 12/1939 | Muskat et al. | 423/75 |
| 2,184,885 | 12/1939 | Muskat et al. | 423/75 |
| 2,852,362 | 9/1958 | Daubenspeck et al. | 423/75 |
| 2,933,373 | 4/1960 | Love et al. | 423/75 |
| 3,159,454 | 12/1964 | Wilcox | 423/75 |
| 3,803,287 | 4/1974 | Fukushima et al. | 75/1 T |
| 3,870,506 | 3/1975 | Robinson et al. | 423/75 |

*Primary Examiner*—Herbert T. Carter

*Attorney, Agent, or Firm*—Connolly and Hutz

[57] ABSTRACT

The disclosure relates to a process for making titanium dioxide concentrates from material containing titanium oxide and iron oxides. More particularly, the titanium oxide-containing material is calcined at temperatures of 870° to 1300° C., and then treated with a chlorine-containing gas at temperatures of 800° to 1300° C., if desired with addition of carbon.

5 Claims, No Drawings

PROCESS FOR MAKING TITANIUM DIOXIDE CONCENTRATES

The present invention relates to a process for making titanium dioxide concentrates by removing iron from material containing titanium oxide and iron oxides with the aid of a chlorine-containing gas and with addition of carbon, if desired, at temperatures of 800° to 1300° C.

A process for removing iron from an iron/titanium-ore has been described in U.S. Pat. No. 2 184 885, wherein an intimate mixture of the ore with 1 to 12 weight % carbon is chlorinated at temperatures higher than 500° C., the bulk of the iron and considerable proportions of titanium becoming evaporated in chloride form. The remaining residue substantially consists of titanium dioxide of low iron content.

It has also be described (of. German Patent Application No. P 32 03 482.2) that iron can be removed from material containing titanium oxide by allowing the latter at temperatures of 800° to 1300° C. either to move under the action of gravity and treating it in countercurrent fashion with chlorine gas containing at most 30 volume % inert gas, or by fluidizing the material containing titanium dioxide by means of the chlorine gas containing inert gas.

Material containing titanium oxide whether or not admixed with carbon tends to sinter together at elevated temperatures. Sintered material containing titanium oxide reacts however very reluctantly only with a chlorine-containing gas mixture so that the reaction of chlorine is practically restricted to the surface area of compact fragments of the titanium oxide-containing material. Even in the event of the material containing titanium oxide being fluidized by means of the chlorine-containing gas mixture, sinter effects are liable to result from any irregularity in gas distribution.

The present invention now provides a process for making titanium dioxide concentrates by subjecting material containing titanium oxide and admixed with carbon, if desired, to treatment with a chlorine-containing gas at elevated temperatures, the titanium oxide-containing material being prevented from sintering together. To this end, the invention provides more particularly for the material containing titanium oxide to be calcined at temperatures of 870° to 1300° C. prior to removing iron therefrom.

Further optional and preferred features of the present process provide:

(a) for the material containing titanium oxide to be calcined at temperatures of 900° to 1050° C.;

(b) for the material containing titanium oxide to consist of particles with a size of 20 to 1000 μm;

(c) for the material containing titanium oxide to be calcined under inert gas;

(d) for the material containing titanium oxide to be calcined in an oxidizing atmosphere and comminuted to particles with a size of 60 to 600 μm .

Titanium oxide-containing materials particularly useful in the process of this invention comprise more specifically: ilmenite (principal constituents: $FeTiO_3$, $Fe_2O_3$, $TiO_2$); leucoxene (efflorescence product of ilmenite) or titanomagnetite (principal constituents: $Fe_3O_4$, $Fe_2O_3$, $TiO_2$).

In the event of the titanium oxide-containing material containing also oxidically combined vanadium, the latter becomes simultaneously volatilized in chloride or oxychloride form, in the process of this invention.

In the event of effecting the calcination in accordance with this invention under inert gas, e.g. nitrogen, the flowability of the material containing titanium oxide remains practically unaffected. If calcined in an oxidizing atmosphere, e.g. under air, the material containing titanium oxide is liable to form compact fragments which have to be comminuted, preferably by grinding.

As the material containing titanium oxide treated in accordance with this invention practically no longer tends to sinter, it is possible for the treatment with the chlorine containing gas to be effected on loosely aggregated material.

In the following Examples, the percentages are by weight unless otherwise stated.

EXAMPLE 1

(Comparative Example)

200 g ilmenite consisting of particles with a size of 60 to 200 μm and composed of 53.5% $TiO_2$, 32% iron and 0.07% vanadium was placed in a quartz tube (50 mm wide) and dried for 30 minutes at 200° C. under nitrogen. Next, the nitrogen was replaced by chlorine gas (30 l/h) and the reaction zone was heated to 1000° C. The initially strong evolution of $FeCl_3$ subsided after about 45 minutes. The chlorination was effected over a total period of 3 hours. After cooling, it was found that just the surface of the aggregated material was covered with a practically white loose powder. The balance portion of the aggregated material was found to have sintered together to a compact fragment which obviously had failed to react with the chlorine gas. The decrease in weight was as low as 23.0 g.

EXAMPLE 2

(Comparative Example)

40 g ilmenite with the particle size and composition indicated in Example 1 was blended with 8 g coke (particle size smaller than 200 μm) and the whole was introduced into a quartz tube (50 mm wide) in upright position and provided with a sealed-in frit. Next, the material was dried for 30 minutes at 200° C. while nitrogen was passed through. The nitrogen was then replaced by chlorine gas (40 l/h) and the temperature was rapidly increased to 850° C. As soon as the initially strong evolution of $FeCl_3$ was found to be accompained by the formation of $TiCl_4$, the introduction of chlorine gas was discontinued and air was admitted (100 l/h) for combustion of the coke in excess. After the apparatus had been opened, a compact channelled structure was found to have been formed therein. As the chlorine gas obviously had undergone reaction at the surface areas of the channels only, the decrease in weight was as low as 13.2 g.

EXAMPLE 3

(Invention)

80 g ilmenite with the particle size and composition indicated in Example 1 was calcined for 1 hour at 1000° C. under nitrogen. Next, the material was placed in a quarts tube (50 mm wide) in upright position and provided with a sealed-in frit, and heated therein to 1000° C. while chlorine gas was passed through (30 l/h). After a reaction period of 3 hours, gaseous iron (III) chloride practically ceased to be evolved.

43.0 g loose, flowable bright powder which contained 98.0% $TiO_2$, 0.2% $Fe_2O_3$ and less than 0.001% $V_2O_5$ was retained as residue in the quartz tube.

EXAMPLE 4

(Invention)

80 g ilmenite with the particle size and composition indicated in Example 1was calcined for 1 hour at 1000° C. under nigen. Next, the calcined material was placed in a quartz tube (50 mm wide) in upright position and provided with a sealed-in frit, and heated therein to 950° C. while chlorine gas was passed through (100 l/h). After a reaction period of 75 minutes, gaseous iron (III) chloride practically ceased to be evolved.

44.5 g bright flowable powder which contained 97.2% $TiO_2$, 0.6% $Fe_2O_3$ and 0.001% $V_2O_5$ was retained as residue in the quartz tube.

EXAMPLE 5

(Invention)

Example 4 was repeated save that the ilmenite was calcined, prior to chlorinating it, under air (which replaced the nitrogen) and was successively finely ground (particle size: 60 to 600 μm).

44.8 g bright flowable material containing 97.0% $TiO_2$, 0.6% $Fe_2O_3$ and 0.001% $V_2O_5$ was retained as residue in the quartz tube.

EXAMPLE 6

(Invention)

40 g ilmenite with the particle size and composition indicated in Example 1 was calcined for 1 hour at 950° C. under nitrogen and blended with 4 g coke (particle size smaller than 200 μm). Next, the mixture was placed in a quartz tube (50 mm wide) in upright position and provided with a sealed-in frit, and treated inside the tube at 900° to 950° C. while chlorine gas was passed through (60 l/h) for as long as necessary until $TiCl_4$ commenced forming. The chlorine gas was then replaced by air (100 l/h) for combustion of unreacted coke.

46.2 g brown flowable powder containing 91.0% $TiO_2$, 6.5% $Fe_2O_3$ and 0.02% $V_2O_5$ was retained as residue in the quartz tube.

We claim:

1. In a process for making titanium dioxide concentrates by removing iron from material containing titanium oxide and iron oxides, wherein the titanium oxide-containing material is calcined at temperatures of 870° to 1300° C., and wherein the calcined titanium oxide-containing material is treated in countercurrent fashion wit a chlorine-containing gas at temperatures of 800° to 1300° C., the improvement according to which the titanium oxide-containing material is calcined under inert gas, whereby sintering of said material during chlorine-containing gas treatment is prevented.

2. The process as claimed in claim 1, wherein the calcined material is admixed with carbon.

3. The process as claimed in claim 1, wherein the material containing titanium oxide and iron oxides consists of particles with a size of 20 to 100 μm.

4. The process as claimed in claim 1, wherein the material containing titanium oxide and iron oxides is calcined at temperatures of 900° to 1050° C.

5. The process as claimed in claim 1, wherein the thus-calcined material containing titanium oxide and iron oxides is in a loosely aggregated state during the chlorine-containing gas treatment.

* * * * *

UNITED STATES PATENT AND TRADEMARK OFFICE

CERTIFICATE OF CORRECTION

PATENT NO. : 4,517,163

DATED : MAY 14,1985

INVENTOR(S) : KLAUS JODDEN ET AL

It is certified that error appears in the above-identified patent and that said Letters Patent is hereby corrected as shown below:

Column 4, line 18: "Wit" should be "with".

Column 4, line 27: "100" should be "1000".

Signed and Sealed this

*Twenty-fourth* Day of *December 1985*

[SEAL]

*Attest:*

DONALD J. QUIGG

*Attesting Officer*

*Commissioner of Patents and Trademarks*